United States Patent [19]

Dierksheide

[11] 4,356,922

[45] Nov. 2, 1982

[54] COLLAPSIBLE SADDLE RACK

[76] Inventor: Cornell W. Dierksheide, 13115 Wayne Rd., Bradner, Ohio 43406

[21] Appl. No.: 131,068

[22] Filed: Mar. 17, 1980

[51] Int. Cl.[3] ..... A47F 7/00

[52] U.S. Cl. ..... 211/13; 211/99; 211/104

[58] Field of Search ..... 211/13, 104, 99, 116

[56] References Cited

U.S. PATENT DOCUMENTS

| | | | |
|---|---|---|---|
| 1,100,637 | 6/1914 | Vroom | 248/294 |
| 2,678,792 | 5/1954 | Gallion et al. | 248/225.3 |
| 2,740,532 | 4/1956 | Kleinsmith | 211/104 |
| 2,952,366 | 9/1960 | Botten | 211/104 |
| 3,233,745 | 2/1966 | Hershberger | 211/104 |
| 3,285,423 | 11/1966 | Bar-Giora | 211/104 X |
| 3,780,971 | 12/1973 | DeFilipps | 211/104 X |

*Primary Examiner*—Roy D. Frazier
*Assistant Examiner*—Robert W. Gibson, Jr.
*Attorney, Agent, or Firm*—Wilson, Fraser, Barker & Clemens

[57] ABSTRACT

The invention provides a collapsible saddle rack for wall mounting. The rack is easily moveable from an upper operative position presenting a horizontally disposed rack to a lower position in which the rack is pivoted downwardly to a position of rest against an associated wall. The rack includes a mounting plate, and two frame members pivotally mounted on the plate. In the operative position, the frame members interengage and are self-supporting, but may be easily disengaged and swung to their retracted positions.

1 Claim, 5 Drawing Figures

COLLAPSIBLE SADDLE RACK

BACKGROUND OF THE INVENTION

Saddle racks for mounting on a supporting wall are known in the art. Such racks project outwardly from the associated supporting wall to provide horizontal surfaces for racking a saddle. Typically, a rigid frame structure composing the rack is attached to a wall at two or more vertically spaced apart points, thereby bracking the rack against the downward force of its load. A disadvantage of commonly known saddle racks is the excessive space they require when not in use.

U.S. Pat. No. 1,100,637 to Vroom discloses a retractable, wall mounted harness hook, which employs a relatively complicated mechanism to shift the hook from its upper operative position to its lower retracted position.

There is, therefore, a need for a simple, strong and reliable saddle rack which may be easily shifted from an upper operative position to a lower retracted position.

SUMMARY OF THE INVENTION

The invention provides a collapsible saddle rack including a pair of cooperating frame members, each pivotally mounted to a wall mounted bracket. The upper frame member is pivotally connected to the wall mounting bracket for rotation about a horizontally disposed hinge. The lower frame member is similarly mounted on a horizontally disposed hinge, below the hinge supporting the upper frame member. The notch or hook is formed on the underside of the upper frame member. In the upper operative position of the saddle rack, this notch or hook receives the outer end of the lower frame member. The interengagement of the two frame members prevent their rotation on their hinge mountings, thereby forming a rigid self-supporting frame. When it is desired to collapse the saddle rack to a lower position of non-use the upper frame member is pivoted upward slightly to disengage the lower frame member, thus allowing both frame members to be pivoted downwardly to a position of rest against the supporting wall.

BRIEF DESCRIPTION OF THE DRAWINGS

The above objects and advantages of the invention will become readily apparent to one skilled in the art from reading the following detailed description of an embodiment of the invention when considered in light of the accompanying drawing, in which.

DESCRIPTION OF PREFERRED EMBODIMENT

Figure 1:
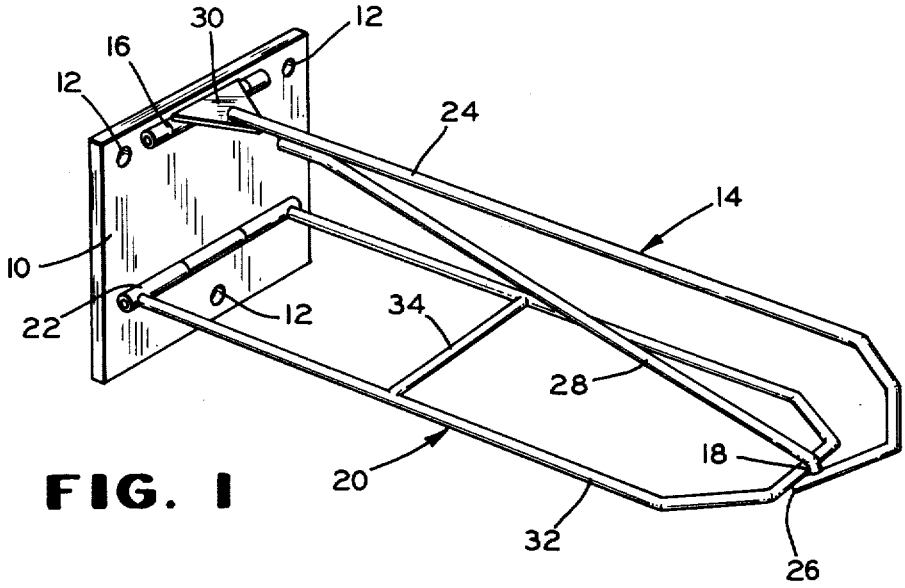
FIG. 1 is a perspective view of a rack incorporating the features of the invention shown in its upper operative position.
Figure 2:
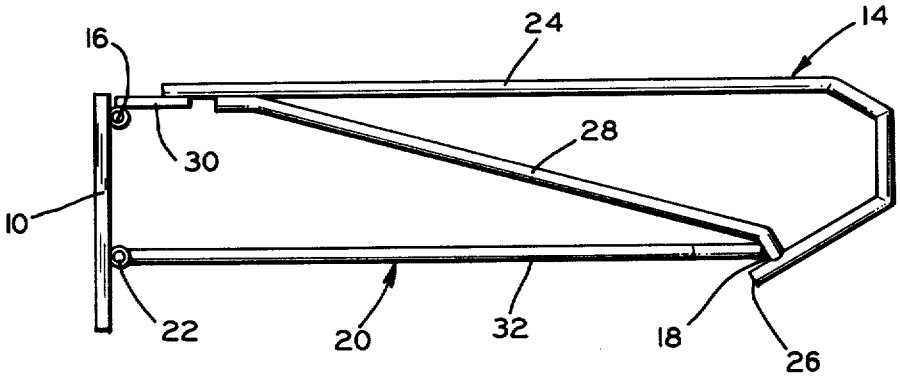
FIG. 2 is a side elevation of the rack illustrated in FIG. 1.
Figure 3:
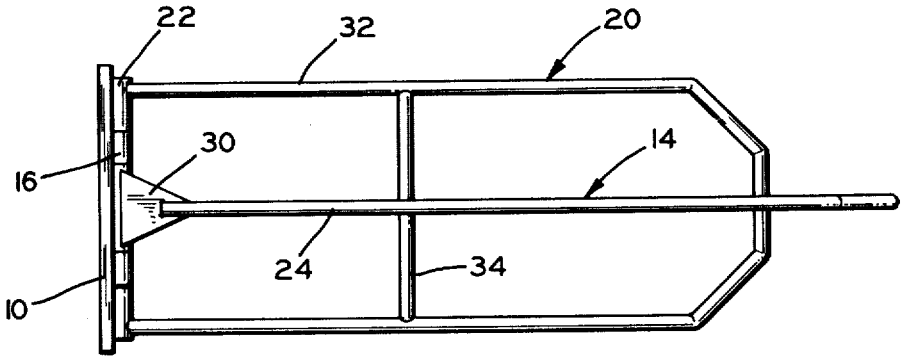
FIG. 3 is a top plan view of the rack illustrated in FIGS. 1 and 2.

Referring to the drawings, a collapsible saddle rack embodying the features of this invention includes a mounting plate 10, an upper frame member 14 and a lower frame member 20. Frame members 14 and 20 are typically formed of a rigid material, such as welded steel rod, for example.

Figure 5:
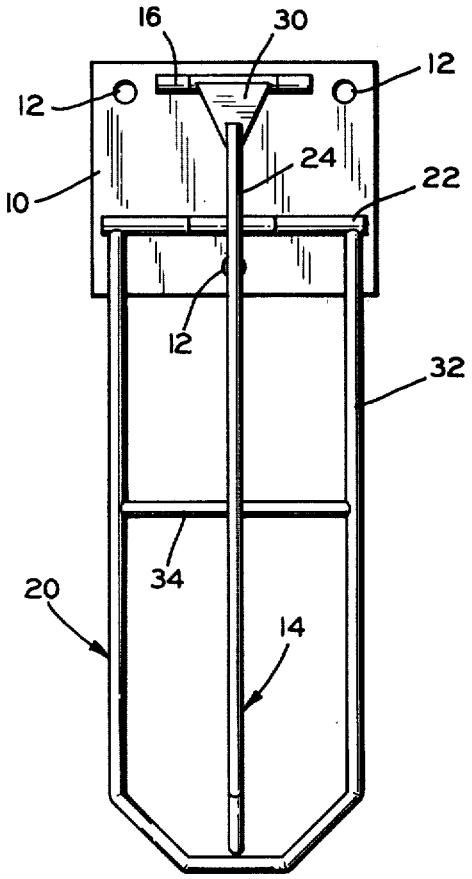
FIG. 5 is a front elevational view of the rack in a retracted position against a supporting wall position.

Mounting plate 10 is provided with a plurality of apertures 12 for receiving threaded fasteners by which the mounting plate 10 may be suitably secured to a supporting wall. Plate 10 carries the upper frame member 14 and the supporting lower frame member 20 by a pair of spaced apart upper and lower hinges 16 and 22, respectively. Upper hinge 16 and lower hinge 22 are mounted on plate 10 with their axes horizontal, and parallel to the associated wall and to each other. Frames 14 and 20 are therefore hinge mounted for rotation in the same vertical plane. In their lower position, as illustrated in FIG. 5, frames 14 and 20 hang or depend from their respective hinges 16 and 22 and rest against the wall. In their upper operative position, the frames are rotated through approximately 90° upwardly and outwardly from the wall, and present a rack for supporting a saddle, for example.

The upper frame 14 comprises an upper rod 24, a lower rod 28, and a triangular bracket 30. Upper rod 24 and lower rod 28 are welded together at their ends near the hinge 16. As they extend outward from plate 10, they diverge in a vertical plane. The outer end of upper rod 24 is bent downwardly and back towards mounting plate 10, and is attached to the outermost end of lower rod 28, thereby forming the looped frame member 14. The extreme terminal end 26 of upper rod 24 extends beyond the juncture of upper rod 24 and lower rod 28. Lower rod 28 and end 26 therefore define a hook or notch 18 on upper frame member 14. Notch 18 opens in a direction generally toward the mounting plate 10. The upper frame member 14 is attached to the upper hinge 16 by a triangular bracket 30, which assists in bracing the upper frame 14 against lateral flexing.

The lower frame 20 comprises a generally U-shaped rod 32 whose ends are attached to the lower hinge 22. A lateral brace 34 is employed to strengthen the lower frame 20.

In the rack's upright position, the outer end of lower frame 20 is engaged by the notch 18 formed at the juncture of lower rod 28 and the extreme end 26 of upper rod 24. A load on the upper frame 14 tends to pivot frame 14 downward on hinge 16, thus increasing the component of force urging notch 18 against the lower frame 20. In this position, upper rod 24 and the lateral extension of lower frame 20 present a stable triangular framework for racking a saddle, which is stabilized by cross brace 34 and triangular bracket 30. A saddle placed on the rack will be supported at the top by upper frame rod 24, and at its sides by the sides of lower frame member 32.

Figure 4:
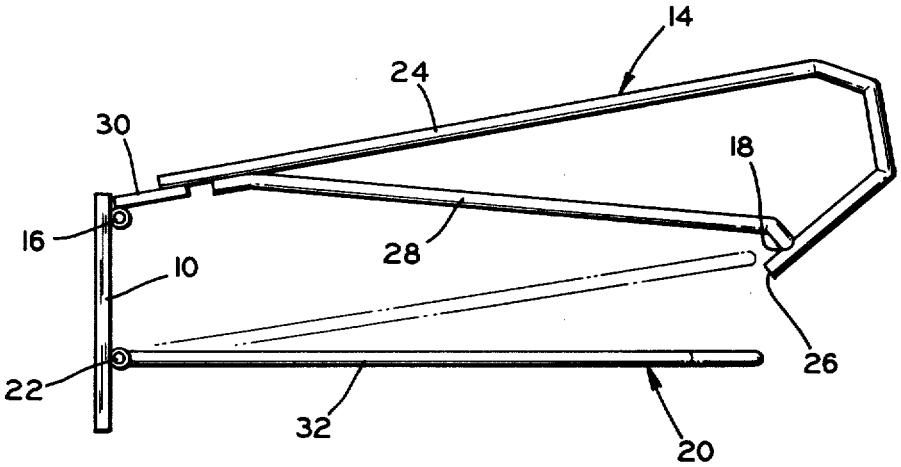
FIG. 4 is a side elevational view of the rack illustrated in FIGS. 1, 2 and 3 illustrating the motion necessary to disengage the two associated frame members.

To collapse the rack, the upper frame 14 is lifted until the lower frame 20 slips out of engagement with the end 26 of rod 14, as illustrated in FIG. 4. Both frame members may then be pivoted to a lower position, resting against a wall, as illustrated in FIG. 5.

In accordance with the provisions of the patent statutes, the principle and mode of operation of the apparatus have been explained and what is considered to represent its best embodiment has been illustrated and described. It should, however, be understood that the invention may be practiced otherwise than as specifically illustrated and described without departing from its spirit or scope.

What is claimed is:

1. A collapsible storage rack comprising a generally vertically disposed mounting plate; an upper frame member; a lower frame member including a U-shaped frame having sides arranged to give lateral support to the sides of a saddle and said upper frame member including a rod spaced above and between the U-shaped frame of said lower frame member whereby a saddle supported on said frame members is supported by the rod of said upper frame member and the sides of said U-shaped frame of said lower frame member; hinge means hingedly attaching said upper and lower frame members to said mounting plate for rotation about vertically spaced apart horizontal axes; and a hook extension arranged to define a notch open generally towards said mounting plate at the distal end of said upper frame member and arranged to receive the distal end of said lower frame member, whereby said frame members interengage and are self-supporting in an upper load-bearing position, and may be disengaged and rotated to a lower collapsed position.

* * * * *